US005836021A

United States Patent [19]

Davidson et al.

[11] Patent Number: 5,836,021

[45] Date of Patent: Nov. 17, 1998

[54] NOVELTY TOILET PULL CHAIN AND TANK VALVE ACTUATOR

[76] Inventors: Gary L. Davidson; Sherri L. Davidson, both of Rte. 1, Box 95A, Dewey, Okla. 74029

[21] Appl. No.: 822,491

[22] Filed: Mar. 24, 1997

[51] Int. Cl.[6] ..... E03D 5/09

[52] U.S. Cl. ..... 004/411; 004/412

[58] Field of Search ..... 4/405, 411, 414; 16/112, 122; D8/303

[56] References Cited

U.S. PATENT DOCUMENTS

| | | | |
|---|---|---|---|
| 605,989 | 6/1898 | Bean | 4/412 |
| 849,436 | 4/1907 | Sullivan | 4/405 |
| 1,465,759 | 8/1923 | Dey | 16/303 |
| 1,601,210 | 9/1926 | Haas . | |
| 1,623,109 | 4/1927 | Haas . | |
| 1,667,990 | 5/1928 | Rogers . | |
| 2,046,888 | 7/1936 | Watt . | |
| 2,145,601 | 1/1939 | Hopper . | |
| 2,304,512 | 12/1942 | Stanley . | |
| 2,843,854 | 7/1958 | McKinnon . | |

FOREIGN PATENT DOCUMENTS

| | | |
|---|---|---|
| 6223 | 2/1893 | Switzerland . |
| 1016978 | 1/1996 | United Kingdom . |

*Primary Examiner*—Charles E. Phillips
*Attorney, Agent, or Firm*—Richard C. Litman

[57] ABSTRACT

A flexible chain and cord-and-return mechanism used in flushing a toilet. A handle is removably attached to the end of the chain. Various handles are designed in a multitude of shapes including objects relating to a decorating theme, a special occasion or event, or a hobby or interest. The chain passes into the toilet housing through a smooth opening with minimal friction and, within the housing, is connected to a line that passes through a pair of tubes that are slidably connected, the line ending at the tank valve. A spring is fixed to each of the two tubes to return the chain-and-line tank valve actuator to its initial, actuation position after each flushing.

3 Claims, 2 Drawing Sheets

NOVELTY TOILET PULL CHAIN AND TANK VALVE ACTUATOR

BACKGROUND OF THE INVENTION

1. Field of the Invention

The present invention relates generally to toilet flushing mechanisms and, more specifically, to flexible, hanging chain flushing actuators having decorative fobs.

2. Description of the Related Art

Home decorating has become a major industry. Home owners, condominium residents, and apartment dwellers have popularized the decorating concept of matching virtually everything in the home, or in any chosen room, to a certain color, theme, or motif. Bathroom decor has been included in the decorating concept. As homes are sold and apartments re-rented, or even with the changing tastes of a long term resident, redecoration takes place within the home. As a general principle, the more items in a room that match, the more successful or appealing the decorating effort is likely to be. In a bathroom, this includes even the flushing handle on a toilet tank. Thus, there is a need for a toilet flushing handle that is easily interchangeable with other toilet tank flushing handles.

Some people enjoy hosting parties based on a theme or an event and thus, there is often a wish to redecorate temporarily for a specific event. For example, parties are often hosted based on a sporting event such as the National Football League's Super Bowl or the NCAA Men's Basketball Tournament's Final Four. Other events that commonly serve as the basis for a party are school graduations, musical performances or recitals, and so forth. Holidays such as Christmas, Halloween, Thanksgiving, and the New Year also commonly serve as the occasion for a party. In all such instances it is quite common for the host of the party to want to redecorate temporarily based on the theme of the party. Thus, there is a need for easily interchangeable toilet tank flushing handles that represent different events, occasions, or motifs.

Decorating themes in rooms frequented by children often reflect the interests of those children. For example, children's bedrooms are often decorated with items that reflect a favorite sport or team, or a favorite movie, cartoon, storybook or religious character. Bathrooms used by children are also often accessorized with items that catch the fancy of children, such as boats, a specific animal, e.g., a rabbit, religious/biblical theme, etc.. However, the interests of children often are temporary and transient. That is, the interest of a child in any one theme may be short-lived. Thus, there is a need for toilet tank flushing handles that reflect a variety of characters, sports, teams, figures, or other interests of children.

Parents generally find fanciful distractions beneficial when encouraging acts of pediatric hygiene such as tooth brushing and bathing. Toilet training is another aspect of pediatric hygiene encouraged by parents. Thus, there is a need for easily interchangeable toilet tank flushing handles that embody the interests and fancies of children.

One way to achieve an interchangeable toilet tank flushing handle is to utilize a flexible hanging chain as the toilet flushing mechanism from outside to inside the toilet housing. The following patents show a hanging chain as such a toilet flushing actuator. U.S. Pat. No. 2,145,601 issued to Samuel E. Hopper on Jan. 31, 1939, teaches a toilet flush tank with a chain from an outside pull handle through a guide tube to the vertical stem of the tank valve. The particular interchangeable fob, bent guide tube, chain-and-line, and return spring arrangement of the instant invention are not taught in the Hopper patent. U.S. Pat. Nos. 1,601,210 and 1,623,109, issued to Philip Haas on Sep. 28, 1926, and Apr. 5, 1927, respectively, disclose an exterior handle on a chain end, the chain then extending inside of the tank to the upper arm connection to the tank or flushing valve ('109 patent), and a flexible chain from the tank ball or valve through a guide tube to the exterior of the tank ('210 patent), but not the interchangeable fob, or the chain-and-line with bent guide tube and return spring construction of the instant invention.

The following prior patents are of interest with respect to the instant invention, but are less relevant than those just discussed. Swiss Patent Number 6223, issued on Feb. 21, 1893 shows an early tank flushing construction with an operating chain and handle located exteriorally of the tank. Patents teaching an operating chain for the tank valve and located internally of the tank include British Patent Number 1,016,978, issued on Jan. 12, 1966, and: U.S. Pat. No. 1,667,990, issued to Robert Rogers on May 1, 1928; U.S. Pat. No. 2,046,888, issued to Wayne C. Watt on Jul. 7, 1936; U.S. Pat. No. 2,304,512, issued to Walter Stanley on Dec. 8, 1942; and U.S. Pat. No. 2,843,854, issued to Malcolm N. McKinnon on Jul. 22, 1958.

None of the above mentioned patents show interchangeable handles at the end of a flexible chain in a toilet flushing mechanism. Where a flexible hanging chain outside a toilet housing is used in a toilet flushing mechanism, then the mechanism must include provision for returning the chain to its original resting position after the toilet has been flushed. One way to return a toilet flushing actuator chain to its original resting position after flushing is to run the chain through a pair of tubes connected by a spring. None of the above art shows a spring fastened to an outer tube at one end of the spring and fastened to an inner tube protruding from the outer tube at the other end of the spring, a valve actuating line passing through both tubes to the tank valve.

None of the above inventions and patents, taken either singularly or in combination, is seen to describe the instant invention as claimed. Thus, a novelty toilet tank pull chain solving the aforementioned needs is desired.

SUMMARY OF THE INVENTION

The present invention is a flexible chain-and-line and a return mechanism used in flushing a toilet. A handle is removably attached to the end of the chain. Various handles are designed in a multitude of shapes including objects relating to a decorating theme, a special occasion or event, or a hobby or interest. The chain passes into the toilet housing through a smooth opening and, within the housing, is connected to a line that passes through a pair of tubes that are slidably interconnected, and on to the tank valve. A spring is fixably attached to each of the two tubes to return the chain-and-line to the tank valve actuation position after each flushing.

Accordingly, it is a principal object of the invention to provide a toilet flushing handle that is easily interchangeable with other toilet flushing handles.

It is another object of the invention to provide toilet flushing handles that match a permanent bathroom decorating theme, a temporary party or other event theme, or the interests of a person who uses the toilet to which the flushing handles are attached.

It is a further object of the invention to provide a flexible flushing chain or cable that traverses the housing of the toilet tank with a minimal amount of friction.

Still another object of the invention is to provide a flexible toilet flushing chain or cable with a mechanism for returning the chain to its tank valve actuation position after flushing.

It is an object of the invention to provide improved elements and arrangements thereof in a toilet pull chain and tank valve actuator for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
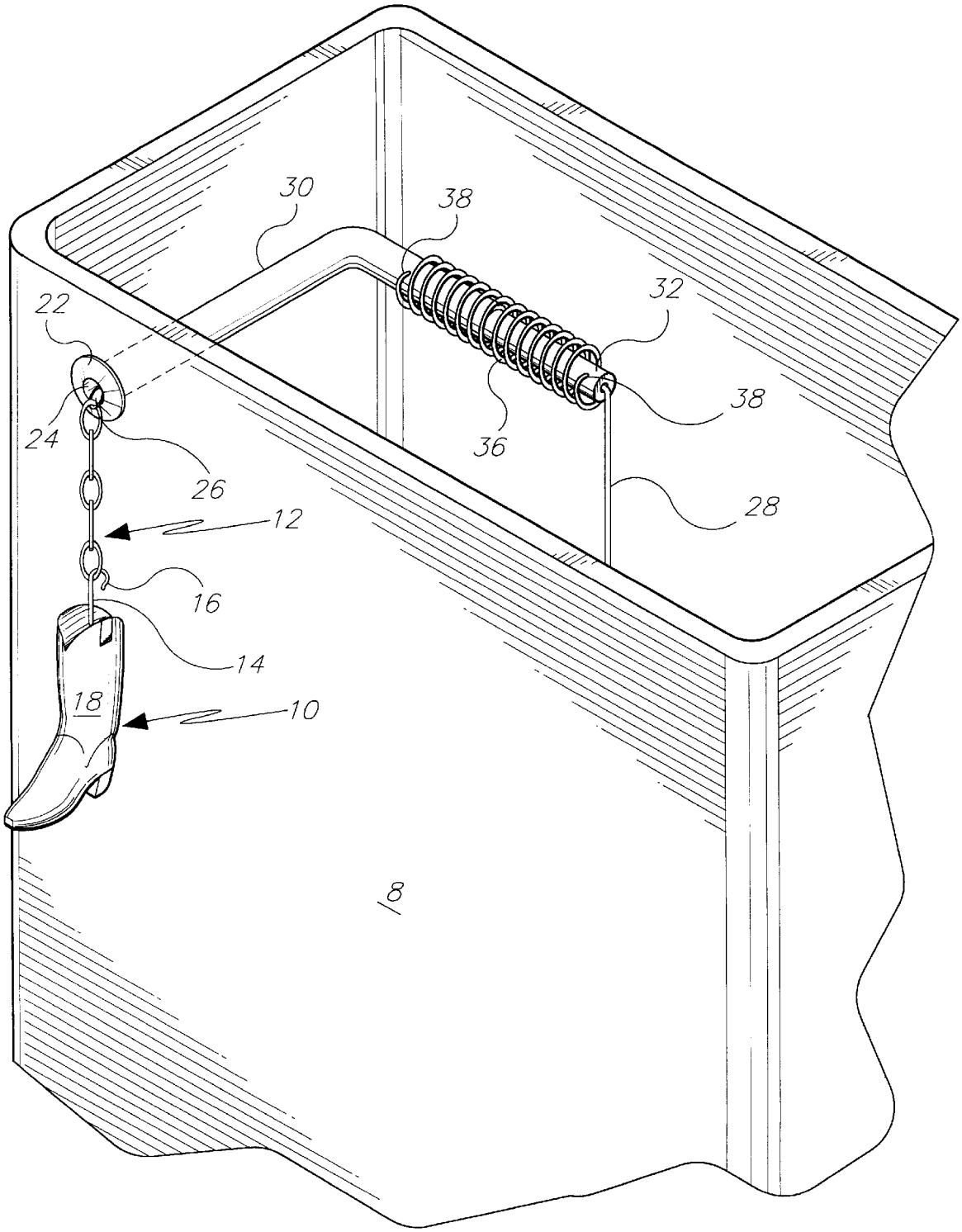
FIG. 1 is a fragmented perspective view of a toilet pull chain and tank valve actuator according to the present invention.

The present invention is directed generally to a tank valve actuator for a toilet 8. The present invention also provides interchangeable toilet flushing handles so that the toilet flushing handle alternately matches a decorating theme, a special occasion or event, or a hobby or other interest or fancy. Referring to FIG. 1, a handle or fob 10 is shown linked to a chain 12 by an attachment hook 14. In the preferred embodiment, the chain 12 is shown having circular links large enough to receive a handle or fob hook 14 that ends in a loop 16. This arrangement enables the handle 10 to be easily removed and replaced. Alternatively, a common figure eight hook could be provided (not shown). A figure eight hook would be slightly more secure and slightly more difficult to remove than the loop 16 shown. Thus, a figure eight hook is preferred to the loop 16 in an environment where children are present. Another acceptable and more secure attachment is a common hook snap (not shown).

Other, suitable chain structures could include the well known beaded chain, made up of a plurality of metal spheres and connections joining the spheres, thereby defining a beaded chain, and this is a suitable substitute for chain 12, hook 14, and loop 16. Yet another acceptable alternative to chain 12 is a common cable with an eye for receiving the hook 14. In the embodiment of the invention that uses a cable with an eye as chain, the various embodiments of the hook 14 described above are fastened to the eye in the cable rather than to a link in a chain as illustrated.

The handle 10 is shown in the form of a boot 18. A boot is one recommended embodiment for a bathroom decorated with an old western or southwestern theme, an adult interested in rodeo or horseback riding, or a child who enjoys cowboys and/or horses. When used to match a bathroom decorating theme, the advantage of this invention is that it increases the degree to which all objects in the room are consistent with the decorating theme. When used to appeal to the interests of an adult, the advantage of this invention is an improvement in fanciful esthetics. When used to appeal to the interests of a child, the advantage of this invention is that it provides a pleasant diversion of the child's attention from at least one aspect of pediatric hygiene generally considered unpleasant to a child—toilet training. Other embodiments suggested for old west or southwestern decor, interest or taste are a saddle, a spur, or a horse.

Other embodiments of this invention that relate to topical interests, tastes, or themes are as follows: a bird, reptile, fish, mammal, or other animal, a spider, or other insect or fancied creature; a cross, an angel, a Bible, an ark, or other religious symbol, saying, or person; a car, pickup truck, tractor-trailer, motorcycle, bicycle, or other mode of transportation or the logo of a favorite manufacturer of that mode of transportation; a domino, chess piece, checker, a playing card, or other object from a game; a tree, a flower, a seashell, or other fancied object of nature; a doctor, a nurse, a fireman, a police officer, a fireman's or police officer's badge, a nurses cap, or other object or person relating to a certain vocation; an apple, an orange, or other type of foodstuff; dishwasher, clothes washer, clothes dryer, refrigerator, or other household appliance; a hammer, a saw, or other tool; a piano, a banjo, a pair of ballet shoes, or other musical instrument or item associated with a performance; a building or a bridge; a tractor or other implement of farm living; a planet, a rocket, or other article relating to outer space; and a gun, a bow and arrow, a tank, an airplane, a helicopter, a bus or other form of commercial or military travel or weapon or military object; a crayon, a doll, a toy, or other item used by children at play; a heart, a teddy bear, a rainbow, or other fanciful item enjoyed by children; a stop sign, yield sign, stop light, speed limit sign, or other traffic related symbol; a soda can or bottle; and a movie or cartoon character. The possibilities are, of course, endless.

Figure 2:
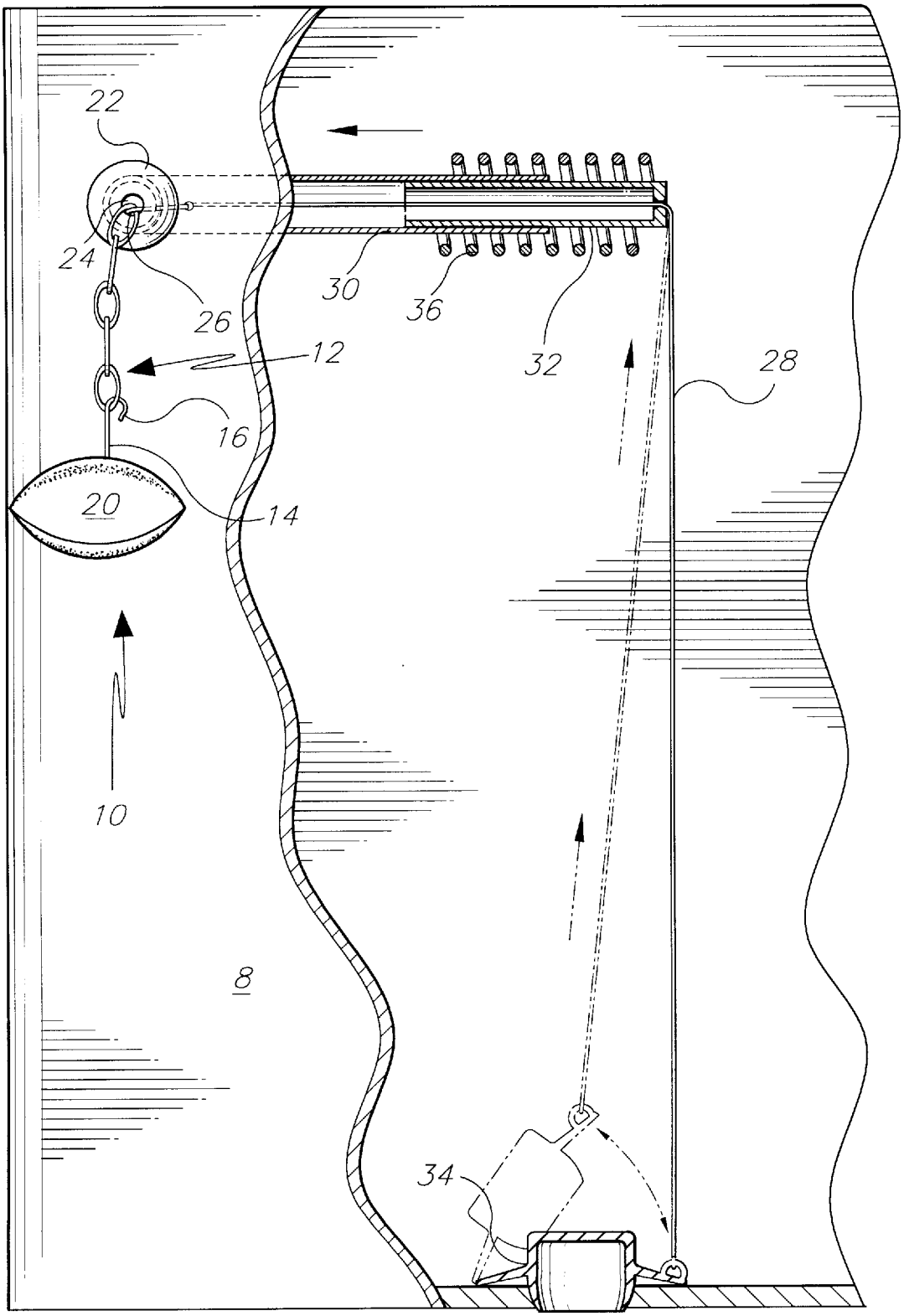
FIG. 2 is an elevational, partially sectional, front view of a novelty toilet pull chain according to the present invention.

Referring to FIG. 2, the handle 10 is shown in the form of a football 20. The football 20 embodiment is recommended for a bathroom frequented by a fan of the sport of football or for temporary use during a party based on a football game. Other embodiments of this invention recommended for sports fans or events are baseball and football helmets, hats, caps, bats, balls, clubs, sticks, spikes and other various equipment used in the preferred sport. Other embodiments of this invention that are used as party themes include holiday symbols such as a bunny during Easter, a pine tree during Christmas, a turkey during Thanksgiving, a witch, ghost, or carved pumpkin during Halloween. Some embodiments of the handle 10 represent organizational affiliation such as a business or company logo, a logo for a branch of the military or other military unit, a college or university mascot or logo, a state flag, or other organization symbol or logo.

The interchangeability of the handle 10 provides utility in a number of ways. As sports seasons change, a handle 10 with an athletic symbol associated with that sport or favorite team logo is exchanged for a handle 10 in a shape that corresponds to the new sport's season. During a party, the handle 10 is temporarily replaced with a handle 10 relating to the theme of the party. As individual interests change, or as the bathroom is redecorated either by the same or a new resident, a handle 10 that matched the old decorating theme or interest is replaced with a new handle 10 that matches the new decorating theme or interest. Alternatively, the handle 10 merely reflects a person, place, or thing of individual fancy.

Any common method of manufacturing small articles in a specific shape, such as injection molding, is acceptable for fabricating the handle 10.

The tank valve actuator construction of the instant invention will now be discussed. Referring again to FIG. 1, a plug insert 22 fills an opening 24 defined in the toilet tank 8. The insert 22 is provided with a smooth and flaring or curved surface so as to cause only the slightest friction on the chain 12. The surface of the insert 22 may be coated in any known fashion (e.g., with Teflon™) to further reduce friction and wear. In the embodiment shown, wherein the loop 16 is fastened to a chain 12 having large links, the chain 12 is connected to a cable or a beaded chain before the chain 12 traverses the liner 22 when the tank valve is closed. This reduces wear and tear on the large links of the chain 12. In the alternative embodiments of the chain 12 that use a beaded chain or a cable, the beaded chain or cable passes through the opening 24 without interruption.

As seen in the views, the final link of the chain 12 is secured to the eye 26 of a tank valve actuation line 28. The line 28 then passes through an outer tube 30, which is mounted on an extension of insert 22 interiorally of the tank (not shown), an inner tube 32 and down to a tank valve 34 in the bottom of the toilet tank 8. The line 28 is fastened directly to the tank valve 34. In an alternative embodiment, a small spring (not shown) is connected directly to the tank valve 34 and the line 28 is hooked onto a link of the small spring. This alternative embodiment enables small adjustments to be made in the tension and length of the line 28.

The inner tube 32 is slidably inserted within the outer tube 30 and in radial surface contact with the outer tube 30. Friction between the inner tube 32 and the outer tube 30 is minimal, and the use of a lubricant or liner material between the inner tube 32 and the outer tube 30 is preferable.

A spring 36 is attached to the outer tube 30 at one end of the spring 36 and to the inner tube 32 at the other end of the spring 36. A small hole 38 having a diameter about the same as the thickness of the spring 36, and for receiving the spring 36, is defined in the inner tube 32 and in the outer tube 30. It should be apparent that any securely attachment of the spring 36 to the outer tube 30 at one end of the spring 36 and to the inner tube 32 at the other end of the spring 36 is acceptable. For example, an equally acceptable alternative embodiment places a wire pin (not shown) in each small hole 38 and a washer around the inner tube 32 and outer tube 30 between the spring 36 and each wire pin. Thus, in this alternative, the spring 36 is secured in place without fixing the spring 36 to any other element.

When the toilet is flushed, the handle 10 is pulled downward or outward. This motion forces open the tank valve 34 allowing the toilet to flush, and forces the inner tube 32 to retract within the outer tube 30 and compress the spring 36. When the handle 10 is released after flushing, the spring 36 returns to its original position, thus forcing the inner tube 32 to telescope back out of the outer tube 30 and force the chain 12 and the handle 10 to return to their initial positions. The above described return action of the spring 36 also permits the tank valve 34 to reseat and seal the toilet tank 8.

Better flushing results are achieved when the line 28 exits the inner tube 32 directly over the tank valve 34. Therefore, the outer tube 30 is shown with an elbow to achieve this preferred orientation of line 28, inner tube 32, and tank valve 34. Acceptable flushing results are also obtained with various other shapes of the outer tube 30. It should be apparent that the ideal shape and orientation of the outer tube 30 and inner tube 32 will vary depending on the construction of the toilet tank 8 and the orientation of the tank valve 34 in the toilet tank 8.

It is within the ambit of the invention to provide and market the invention in kit form, and include a variety of handles or fobs 10, the handles 10 representing a number of themes.

It is to be understood that the present invention is not limited to the embodiments described above, but encompasses any and all embodiments within the scope of the following claims.

I claim:

1. A novelty toilet pull chain and tank valve actuator for mounting on and within a toilet tank and operatively interconnected with the tank valve in the toilet tank, said pull chain and tank valve actuator comprising:

a handle having a predetermined size, configuration and decoration representing a preselected theme;

a chain-and-line means interconnecting a toilet tank valve and said handle, said chain-and-line means including a chain segment attached to said handle and a line segment attached to the toilet tank valve, said chain segment extending from said handle outside of the toilet tank through an opening in a wall of the toilet tank to a location interior of the toilet tank, and having an inner end within the toilet tank, said line segment provided with a loop at one end for connection to said inner end of the chain segment and attached to the toilet tank valve at a second end;

a tube guide mounted within the toilet tank and extending from said opening to a position substantially over the tank valve, said chain segment inner end and said loop being located within said tube guide, said tube guide including:

an inner tube; and an outer tube having a first end mounted at said opening and a second end within which said inner tube is slidably interfitted;

spring means urging said inner and outer tubes apart, whereby upon initiation of a toilet flushing action by pulling on said handle, said spring means are compressed, and then expand to assist in the closing of the tank valve when flushing is complete; and readily detachable means interconnecting said chain segment and said handle, whereby said handle may be readily exchanged for another handle which is shaped and decorated to represent an additional theme.

2. The novelty toilet pull chain and tank valve actuator as claimed in claim 1 wherein said spring means comprise a coil compression spring having a first end affixed to said outer tube and a second end affixed to said inner tube.

3. The novelty toilet pull chain and tank valve actuator as claimed in claim 1, there further being plug insert mounted in said chain segment entry, for facilitating reduced friction movement of said chain segment through said entry.

* * * * *